US011512528B2

(12) United States Patent
Mohammadikashkooli et al.

(10) Patent No.: US 11,512,528 B2
(45) Date of Patent: Nov. 29, 2022

(54) ACTUATION MECHANISM FOR A DYNAMIC FEÇADE

(71) Applicants: Aslan Mohammadikashkooli, Shiraz (IR); Zahra Ghiabaklou, Tehran (IR); Mitra Sharifi, Shiraz (IR)

(72) Inventors: Aslan Mohammadikashkooli, Shiraz (IR); Zahra Ghiabaklou, Tehran (IR); Mitra Sharifi, Shiraz (IR)

(73) Assignee: UNIVERSITY OF TEHRAN, Tehran (IR)

( * ) Notice: Subject to any disclaimer, the term of this patent is extended or adjusted under 35 U.S.C. 154(b) by 0 days.

(21) Appl. No.: 17/378,685

(22) Filed: Jul. 17, 2021

(65) Prior Publication Data

US 2021/0340813 A1 Nov. 4, 2021

Related U.S. Application Data

(60) Provisional application No. 63/053,577, filed on Jul. 18, 2020.

(51) Int. Cl.

| | |
|---|---|
| ***H01F 7/02*** | (2006.01) |
| ***E06B 9/36*** | (2006.01) |
| *E06B 9/68* | (2006.01) |

(52) U.S. Cl.

CPC ..... *E06B 9/368* (2013.01); *H01F 7/021* (2013.01); *H01F 7/0242* (2013.01); *E06B 9/68* (2013.01)

(58) Field of Classification Search

CPC . E06B 9/368; E06B 9/68; H01F 7/021; H01F 7/0242

See application file for complete search history.

(56) References Cited

U.S. PATENT DOCUMENTS

2017/0120401 A1* 5/2017 Fullerton ..... F16K 31/088

FOREIGN PATENT DOCUMENTS

| | | | | |
|---|---|---|---|---|
| DE | 102016112214 A1 * | 1/2018 | ..... | E05B 47/004 |
| DE | 102018209403 A1 * | 12/2019 | ..... | B60L 13/04 |
| GB | 2491174 A * | 11/2012 | ..... | A47K 10/38 |
| JP | 2004324586 A * | 11/2004 | | |

* cited by examiner

*Primary Examiner* — Mohamad A Musleh

(74) *Attorney, Agent, or Firm* — Bajwa IP Law Firm; Haris Zaheer Bajwa

(57) ABSTRACT

A permanent magnet actuation mechanism may include a first permanent magnet magnetized along a first axis and rotatable about a first rotational axis perpendicular to the first axis, a second permanent magnet magnetized along a second axis and rotatable about a second rotational axis perpendicular to the second axis. The first rotational axis is parallel with the second rotational axis. The mechanism further comprises a mounting structure configured to position the first permanent magnet at a first distance from the second permanent magnet along a main axis perpendicular to the first rotational axis and the second rotational axis.

14 Claims, 7 Drawing Sheets

ACTUATION MECHANISM FOR A DYNAMIC FEÇADE

CROSS-REFERENCE TO RELATED APPLICATION

This application claims the benefit of priority from U.S. Provisional Patent Application Ser. No. 63/053,577, filed on Jul. 18, 2020, and entitled "BUILDING FACADE DYNAMIZATION WITH MAGNET," which is incorporated herein by reference in its entirety.

TECHNICAL FIELD

The present disclosure relates to actuation devices and particularly to permanent magnet actuation mechanisms. More particularly, the present invention relates to a rotary permanent magnet actuation mechanism.

BACKGROUND

A dynamic adaptive building façade refers to a building façade that may dynamically relate to a variable environment. In other words, a dynamic adaptive building façade may have the ability to repeatedly change some of its features and functions in a reversible manner, responsive to variable environmental conditions. Such dynamic relationship between a building façade and its surrounding environment may allow for a better overall performance of a building. For example, a dynamic adaptive building façade may include a retractable shading mechanism that may be retracted in winter or whenever it is cloudy and be extended in summer or whenever it is sunny to save energy and to ensure occupant comfort.

A dynamic change in a building façade, such as extending/retracting a shading device, requires actuation of elements of a dynamic adaptive building façade. For example, façade elements need to be moved, rotated, expanded, retracted, shrunk, or twisted. How such actuation is provided is an important factor from an energy-saving point of view. Various methods of actuation may include motorized actuation, hydraulic actuation, and pneumatic actuation. For example, motorized actuation mechanisms may include rotary electric motors coupled to a number of blinds installed in a building façade. A central control mechanism may monitor the light intensity and/or the location of the sun and urge the rotary electric motors to actuate movements of the blinds to adjust the amount of sunlight entering the building. Hydraulic or pneumatic actuation mechanism may include a cylinder-piston configuration, where movement of a piston within a cylinder may produce motion in an external object in the form of linear translation, rotation, or oscillation.

However, utilizing large numbers of electric motors and pneumatic and hydraulic actuators in a building façade may significantly increase the maintenance and repair costs of the building. Furthermore, such large numbers of motors and actuators may not be energy efficient and may require a large amount of energy to operate. There is therefore a need for developing new actuation mechanism that are energy efficient with less moving parts.

SUMMARY

This summary is intended to provide an overview of the subject matter of the present disclosure and is not intended to identify essential elements or key elements of the subject matter, nor is it intended to be used to determine the scope of the claimed implementations. The proper scope of the present disclosure may be ascertained from the claims set forth below in view of the detailed description and the drawings.

According to one or more exemplary embodiments, the present disclosure is directed to a permanent magnet actuation mechanism. An exemplary permanent magnet actuation mechanism may include a first permanent magnet that may be magnetized along a first axis and may be rotatable about a first rotational axis perpendicular to the first axis. An exemplary first permanent magnet may be rotatable between a first primary position and a first secondary position. An exemplary first secondary position may correspond to a position of an exemplary first permanent magnet that may be rotated by 180° about an exemplary first rotational axis, with respect to an exemplary first primary position.

In an exemplary embodiment, an exemplary permanent magnet actuation mechanism may further include a second permanent magnet that may be magnetized along a second axis and may be rotatable about a second rotational axis perpendicular to the second axis. An exemplary second permanent magnet may be rotatable between a second primary position and a second secondary position. An exemplary second secondary position may correspond to a position of an exemplary second permanent magnet that may be rotated by 180° about an exemplary second rotational axis, with respect to an exemplary second primary position.

In an exemplary embodiment, an exemplary permanent magnet actuation mechanism may further include a mounting structure that may be configured to position an exemplary first permanent magnet at a first distance from an exemplary second permanent magnet along a main axis perpendicular to an exemplary first rotational axis and an exemplary second rotational axis.

In an exemplary embodiment, an exemplary first permanent magnet and an exemplary the second permanent magnet may be magnetized along an exemplary main axis. An exemplary first permanent magnet and an exemplary second permanent magnet may be configured to face each other with opposite poles in an exemplary corresponding first initial position and an exemplary second initial position.

In an exemplary embodiment, rotation of an exemplary first permanent magnet about an exemplary first rotational axis from an exemplary first primary position to an exemplary first secondary position in a first direction may actuate a rotation of an exemplary second permanent magnet about an exemplary second rotational axis from an exemplary second primary position to an exemplary second secondary position in a second direction. An exemplary second direction may be opposite an exemplary first direction.

BRIEF DESCRIPTION OF THE DRAWINGS

The novel features which are believed to be characteristic of the present disclosure, as to its structure, organization, use and method of operation, together with further objectives and advantages thereof, will be better understood from the following drawings in which a presently exemplary embodiment of the present disclosure will now be illustrated by way of example. It is expressly understood, however, that the drawings are for illustration and description only and are not intended as a definition of the limits of the present disclosure. Embodiments of the present disclosure will now be described by way of example in association with the accompanying drawings in which.

DETAILED DESCRIPTION

The novel features which are believed to be characteristic of the present disclosure, as to its structure, organization, use and method of operation, together with further objectives and advantages thereof, will be better understood from the following discussion.

The present disclosure is directed to exemplary embodiments of a permanent magnet actuating mechanism that may be utilized for transferring a rotational movement of a rotary actuator, such as an electric motor to an end effector, such as moving parts of a dynamic building façade. An exemplary permanent magnet actuating mechanism may utilize the magnetic forces between linearly arranged permanent magnets to transfer the motion from one permanent magnet to the next.

An exemplary permanent magnet actuating mechanism may include an array of permanent magnets placed next to each other at predetermined distances between each pair of permanent magnets of an exemplary array of permanent magnets. An exemplary array of permanent magnets may include similarly shaped and magnetized permanent magnets placed at various distances between each pair of permanent magnets. An exemplary array of permanent magnets may include a master permanent magnet that may be coupled to a rotary actuator, such as an electric motor and a plurality of slave permanent magnets arranged in an exemplary permanent magnet array next to each other along a main axis. A distance between each pair of permanent magnets in an exemplary array of permanent magnets may incrementally increase between each consecutive pair of permanent magnets moving away from an exemplary master permanent magnet along an exemplary main axis.

An exemplary rotary actuator, such as an electric motor may drive a rotational movement of an exemplary master permanent magnet about a rotational axis perpendicular to an exemplary main axis and then one by one the rotational motion of an exemplary aster permanent magnet may be transferred among exemplary slave permanent magnets. Such transfer of rotational motion among exemplary permanent magnets may be due to magnetic forces between each pair of permanent magnets, as will be discussed.

As mentioned above, the rotational motion of an exemplary master permanent magnet urges other slave permanent magnets in an exemplary permanent magnet actuating mechanism to rotate as well. Such rotation of exemplary permanent magnets about their respective rotational axe, which are all parallel to the rotational axis of the master permanent magnet and perpendicular to the main axis may be transferred to moving elements of a building façade, such as shading blinds. This way, rotational movements of exemplary shading blinds may be actuated by an exemplary permanent magnet actuating mechanism.

Such utilization of permanent magnets for transfer of rotary motion may lead to a considerable reduction in a system's moving parts, since only one electric motor may be required to rotate several moving elements of a building façade.

Figure 1:
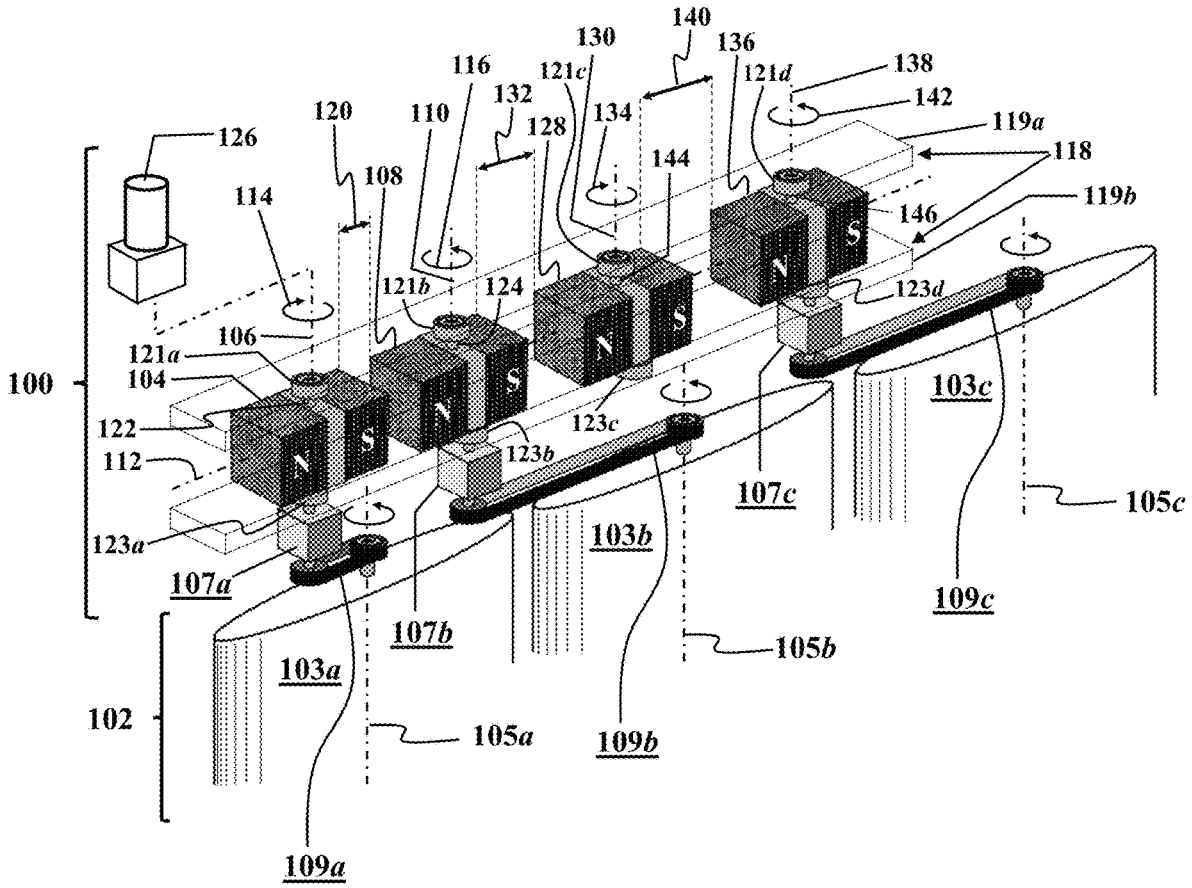
FIG. 1 illustrates a permanent magnet actuating mechanism coupled with a shading assembly, consistent with one or more exemplary embodiments of the present disclosure.

FIG. 1 illustrates a permanent magnet actuating mechanism 100 coupled with a shading assembly 102, consistent with one or more exemplary embodiments of the present disclosure. In an exemplary embodiment, permanent magnet actuating mechanism 100 may include a first permanent magnet 104 that may be rotatable about a first rotational axis 106 between a first initial position and a first secondary position, a second permanent magnet 108 that may be rotatable about a second rotational axis 110 between a second initial position and a second secondary position. In an exemplary embodiment, second rotational axis 110 may be parallel with first rotational axis 106. In an exemplary embodiment, first permanent magnet 104 and second permanent magnet 108 may be magnetized along a main axis 112. In an exemplary embodiment, first permanent magnet 104 and second permanent magnet 108 may face each other with opposite poles in their corresponding first initial position and the second initial position. In an exemplary embodiment, an exemplary initial position of an exemplary permanent magnet is 180° opposite an exemplary secondary position of an exemplary permanent magnet along main axis 112. For example, the first initial position and the second initial position may be 180° opposite the respective first secondary position and the second secondary position along main axis 112.

As used herein, initial position and secondary position of a permanent magnet may refer to positions before and after that permanent magnet is rotated 180° under the influence of an external force. Here, the external force may either refer to a force exerted by a mechanical actuator, or the magnetic force exerted by adjacent permanent magnets. In an exemplary embodiment, the secondary position may correspond to a position of a permanent magnet rotated about a rotational axis of that permanent magnet by 180° with respect to the initial position. For example, the first secondary position corresponds to the position of first permanent magnet 104 rotated with respect to the first initial position by 180° about first rotational axis 106.

In an exemplary embodiment, rotation of first permanent magnet 104 about first rotational axis 106 from the first initial position to the first secondary position in a first direction 114 actuates a rotation of second permanent magnet 108 about second rotational axis 110 from the second initial position to the second secondary position in a second direction 116. In an exemplary embodiment, second direction 116 may be opposite first direction 114.

In an exemplary embodiment, permanent magnet actuating mechanism 100 may further include a mounting structure 118 that may be configured to position first permanent magnet 104 at a first distance 120 from second permanent magnet 108 along main axis 112. In an exemplary embodiment, main axis 112 may be perpendicular to first rotational axis 106 and second rotational axis 110.

In an exemplary embodiment, mounting structure 118 may include a first shaft 122 that may extend along first rotational axis 106 and may be coupled to first permanent magnet 104. In an exemplary embodiment, first shaft 122 may be rotatable with first permanent magnet 104 about first rotational axis 106. In an exemplary embodiment, mounting structure 118 may further include a second shaft 124 that may extend along second rotational axis 110 and may be coupled to second permanent magnet 108. In an exemplary embodiment, second shaft 124 may be rotatable with second permanent magnet 108 about second rotational axis 110.

In an exemplary embodiment, first shaft 122 may either be directly connected or attached to first permanent magnet 104 or may be coupled with first permanent magnet 104 by utilizing a cage or frame. Similarly, second shaft 124 may either be directly connected or attached to first permanent magnet 108 or may be coupled with first permanent magnet 108 by utilizing a cage or frame. For example, second shaft 124 may be attached to a frame 125 that embraces second permanent magnet 108 and thereby second shaft 124 may be indirectly coupled to and rotatable with second permanent magnet 108.

In an exemplary embodiment, permanent magnet actuating mechanism 100 may further include an electromotor 126 that may be coupled to first shaft 122 and may be configured to drive a rotational movement of first shaft 122 about first rotational axis 106. In an exemplary embodiment, the rotational movement of electromotor 126 may be transferred to first permanent magnet 104 via first shaft 122. As mentioned before, since second permanent magnet 108 may be positioned within magnetic field generated by first permanent magnet 104. Any rotational movement of first permanent magnet 104 about first rotational axis 106 may change the orientation of the magnetic field generated by first permanent magnet 104. Consequently, second permanent magnet 108 may rotate about second rotational axis 110 to align and adapt itself with the new orientation of the magnetic field generated by first permanent magnet 104. Such influence of the magnetic field generated by first permanent magnet 104 on second permanent magnet 108 may allow for transferring the rotational movement of first permanent magnet 104 to second permanent magnet 108.

In an exemplary embodiment, permanent magnet actuating mechanism 100 may further include a third permanent magnet 128 that may be rotatable about a third rotational axis 130 between a third initial position and a third secondary position. In an exemplary embodiment, the third initial position may be 180° opposite the third secondary position along main axis 112. In an exemplary embodiment, third rotational axis 130 may be parallel with both second rotational axis 110 and first rotational axis 106. In an exemplary embodiment, third permanent magnet 128 may be mounted on mounting structure 118 and mounting structure 118 may be configured to position third permanent magnet 128 at a second distance 132 from second permanent magnet 108 along main axis 112. In an exemplary embodiment, second distance 132 may be longer than first distance 120.

In an exemplary embodiment, third permanent magnet 128 may be magnetized along main axis 112, such that third permanent magnet 128 and second permanent magnet 108 may face each other with opposite poles in their respective third initial position and the second initial position. In an exemplary embodiment, rotation of second permanent magnet 108 about second rotational axis 110 from the second initial position to the second secondary position in second direction 116 may actuate a rotation of third permanent magnet 128 about third rotational axis 130 from the third initial position to the third secondary position in a third direction 134. In an exemplary embodiment, third direction 134 may be opposite second direction 116. Such rotation of third permanent magnet 128 in response to the rotation of second permanent magnet 108, as discussed above, may be due to the fact that third permanent magnet 128 is positioned within magnetic field generated by second permanent magnet 108. Any rotational movement of second permanent magnet 108 about second rotational axis 110 may change the orientation of the magnetic field generated by second permanent magnet 108. Consequently, third permanent magnet 128 may rotate about third rotational axis 130 to align and adapt itself with the new orientation of the magnetic field generated by second permanent magnet 108. Such influence of the magnetic field generated by second permanent magnet 108 on third permanent magnet 128 may allow for transferring the rotational movement of second permanent magnet 108 to third permanent magnet 128.

In an exemplary embodiment, permanent magnet actuating mechanism 100 may include more permanent magnets, such as a fourth permanent magnet 136 that may be rotatable about a fourth rotational axis 138 between a fourth initial position and a fourth secondary position. In an exemplary embodiment, fourth rotational axis 138 may be parallel with third rotational axis 130, second rotational axis 110, and first rotational axis 106. In an exemplary embodiment, fourth permanent magnet 136 may be mounted on mounting structure 118 and mounting structure 118 may be configured to position fourth permanent magnet 136 at a third distance 140 from third permanent magnet 128 along main axis 112. In an exemplary embodiment, third distance 140 may be longer than second distance 132.

In an exemplary embodiment, fourth permanent magnet 136 may be magnetized along main axis 112, such that fourth permanent magnet 136 and third permanent magnet 128 may face each other with opposite poles in their respective fourth initial position and the third initial position. In an exemplary embodiment, rotation of third permanent magnet 128 about third rotational axis 130 from the third initial position to the third secondary position in third direction 134 may actuate a rotation of fourth permanent magnet 136 about fourth rotational axis 138 from the fourth initial position to the fourth secondary position in a fourth direction 142. In an exemplary embodiment, fourth direction 142 may be opposite third direction 134.

In an exemplary embodiment, mounting structure 118 may further include a third shaft 144 that may extend along third rotational axis 130 and may be coupled with third permanent magnet 128. In an exemplary embodiment, third shaft 144 may be rotatable with third permanent magnet 128 about third rotational axis 130. In an exemplary embodiment, mounting structure 118 may further include a fourth shaft 146 that may extend along fourth rotational axis 138 and may be coupled with fourth permanent magnet 136. In an exemplary embodiment, fourth shaft 146 may be rotatable with fourth permanent magnet 136 about fourth rotational axis 138.

In an exemplary embodiment, mounting structure 118 may be configured as a frame or containment structure. For example, mounting structure 118 may further include two parallel frame members (119*a* and 119*b*) that may be longitudinally spaced apart along first rotational axis 106. In an exemplary embodiment, parallel frame members (119*a* and 119*b*) may be equipped with bearing units (121*a-d*, and 123*a-d*) that may allow for rotatable passage of first, second, third, and fourth shafts (122, 124, 144, and 146) through parallel frame members (119*a* and 119*b*).

In an exemplary embodiment, exemplary permanent magnets of an exemplary permanent magnet actuating mechanism, such as first, second, third, and fourth permanent magnets (104, 108, 128, and 136) of permanent magnet actuating mechanism 100 may include at least one of ferrite permanent magnets, Alnico permanent magnets, and rare-earth magnets, such as samarium-cobalt magnets and neodymium magnets.

In an exemplary embodiment, ceramic or ferrite permanent magnets may be made of sintered composites of powdered iron oxide and barium/strontium carbonate ceramic. Ferrite magnets are non-corroding but brittle and are relatively inexpensive. In an exemplary embodiment, Alnico permanent magnets may be made by casting or sintering a combination of aluminum, nickel, and cobalt with iron and small amounts of other additives. Alnico permanent magnets made by sintering posses superior mechanical characteristics, whereas Alnico permanent magnets made by casting may possess stronger magnetic fields and relatively more intricate shapes. In an exemplary embodiment, rare-earth permanent magnets may include samarium-cobalt and neodymium-iron-boron (NIB) magnets. An exemplary samarium-cobalt magnet is a strong magnet made of two basic elements of samarium and cobalt with relatively high temperature ratings and coercivity. An exemplary neodymium magnet (NdFeB, NIB or Neo magnet) is the most widely used type of rarer-earth permanent magnet. An exemplary neodymium magnet may be made of an alloy of neodymium, iron, and boron to form an $Nd_2Fe_{14}B$ tetragonal crystalline structure.

Figure 3A:
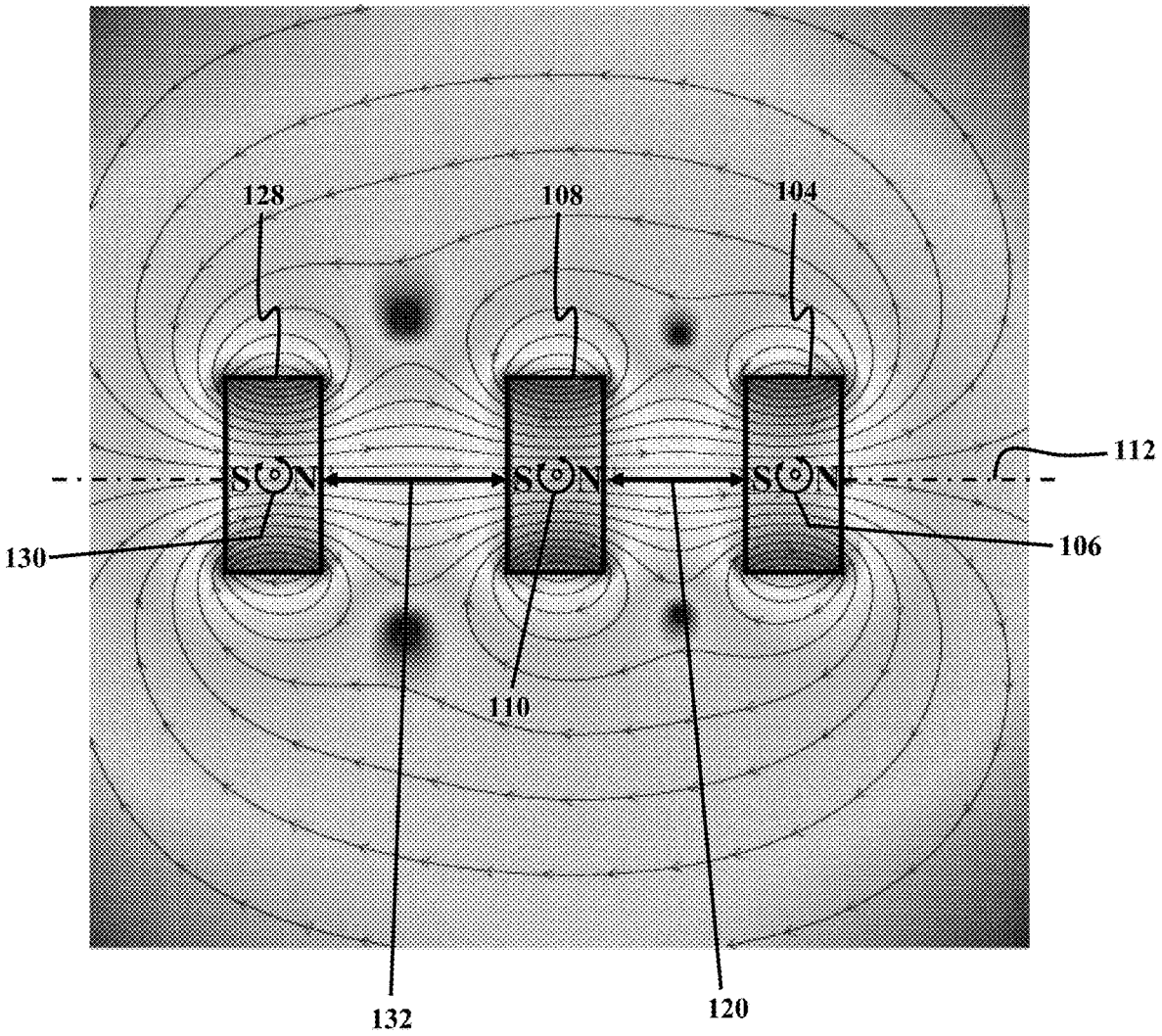
FIGS. 3A-3E illustrate top views of magnetic field lines of three permanent magnets of a permanent magnet actuating mechanism, consistent with one or more exemplary embodiments of the present disclosure.
Figure 3B:
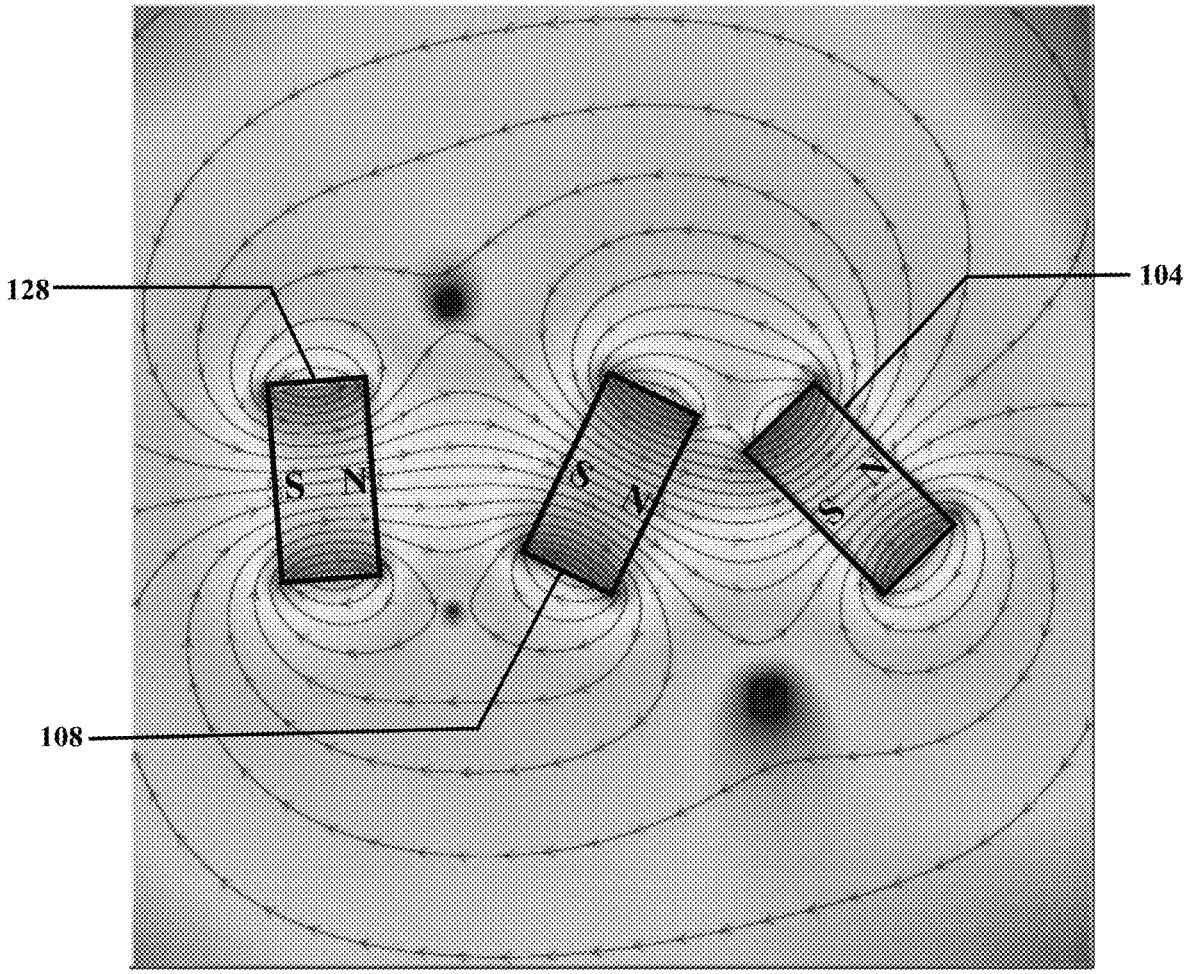

FIGS. 3A-3E illustrate top views of magnetic field lines of three permanent magnets (104, 108, and 128) of permanent magnet actuating mechanism 100, consistent with one or more exemplary embodiments of the present disclosure. FIG. 3A illustrates magnetic field lines of first permanent magnet 104, second permanent magnet 108, and third permanent magnet 128 in a stable initial configuration, where first permanent magnet 104, second permanent magnet 108, and third permanent magnet 128 may be aligned along main axis 112 with their respective opposite poles facing each other. In such stable initial position, first permanent magnet 104, second permanent magnet 108, and third permanent magnet 128 may be maintained in position utilizing mounting structure 118. FIG. 3B illustrates a configuration obtained in response to rotating first permanent magnet 104 about first rotational axis 106 by 45° counterclockwise. As is evident in FIG. 3B, the orientation of magnetic field lines of the magnetic field generated by first permanent magnet 104 has changed due to the 45° rotation. Second permanent magnet 108 is under the influence of the magnetic field generated by first permanent magnet 104. Consequently, a change in magnetic field lines of the magnetic field generated by first permanent magnet 104 may force second permanent magnet 108 to comply with the magnetic field lines of first permanent magnet 104 and thereby second permanent magnet 108 may also start to rotate about second rotational axis 110 in response to the rotation of first permanent magnet 104. As shown in FIG. 3B, second permanent magnet 108 rotates about second rotational axis 110 in a clockwise direction opposite the counterclockwise rotation of first permanent magnet 104. In response to the rotation of second permanent magnet 108, third permanent magnet 128 may be affected and as evident in FIG. 3B, third permanent magnet 128 has rotated slightly in a counterclockwise manner about third rotational axis 130.

Figure 3C:
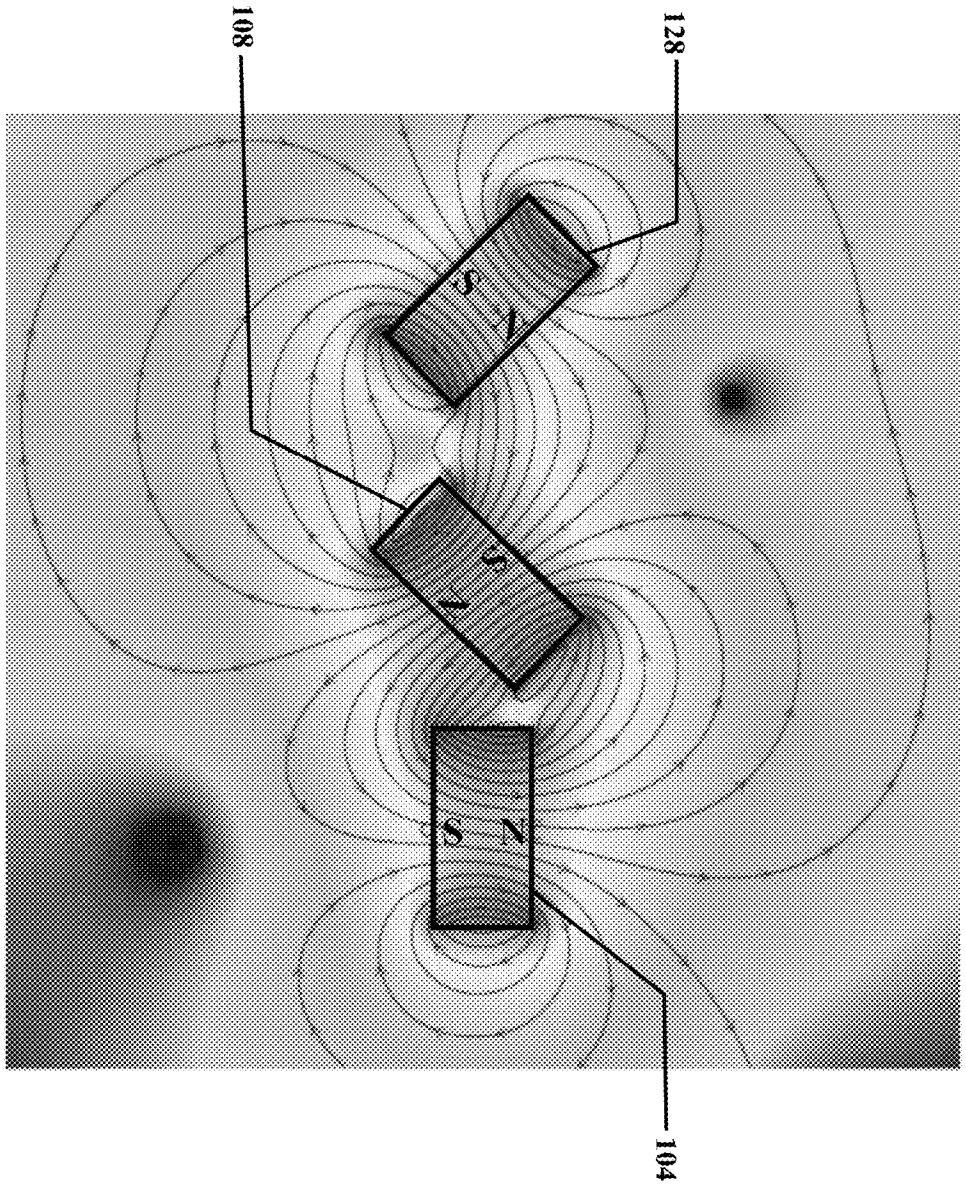
Figure 3D:
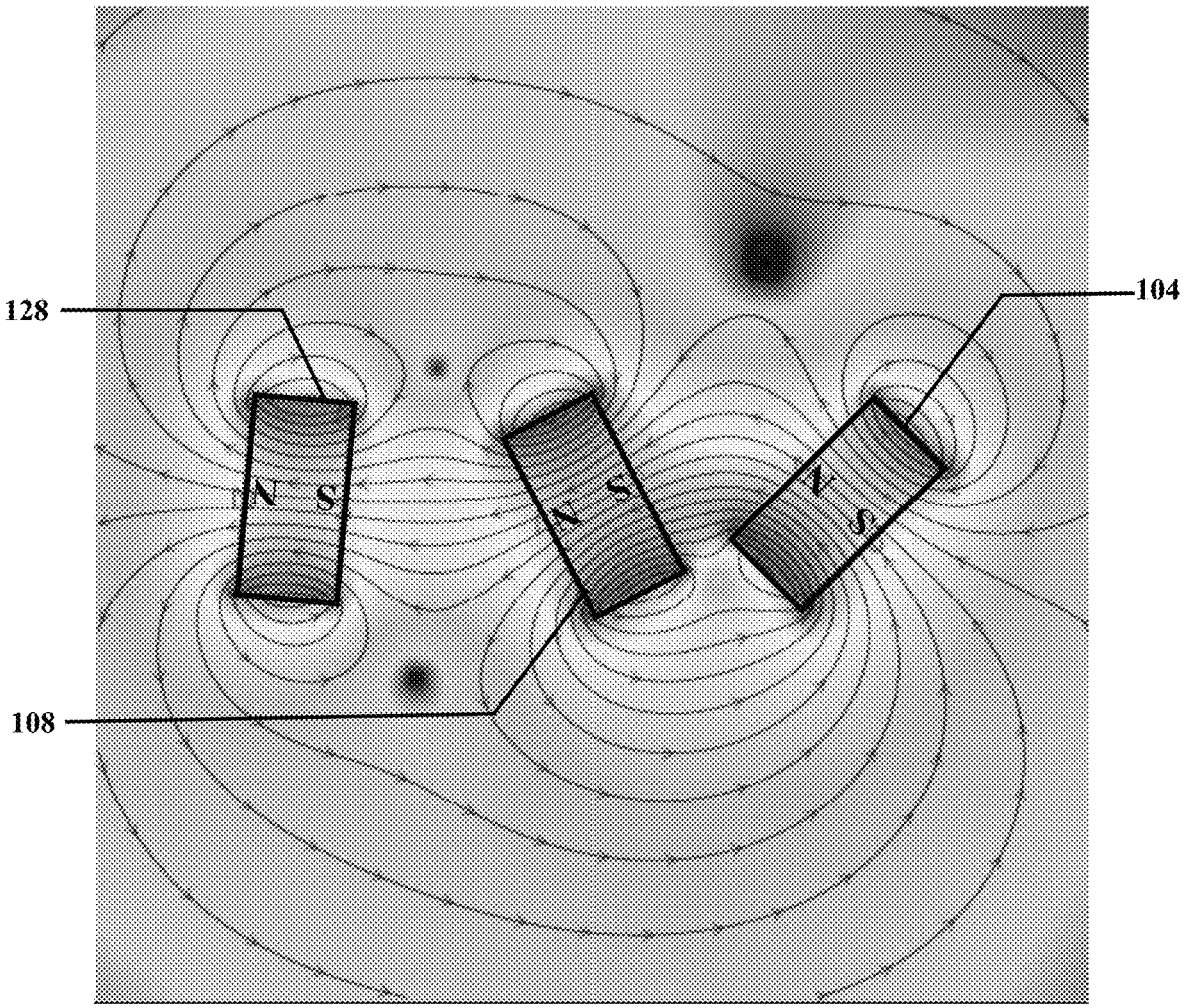

FIG. 3C illustrates a configuration obtained in response to rotating first permanent magnet 104 about first rotational axis 106 by 90° counterclockwise. As evident in FIG. 3C, in response to the rotational movement of first permanent magnet 104 about first rotational axis 106, second permanent magnet 108 and consequently third permanent magnet 128 may further rotate about their respective rotational axes (110, 130). FIG. 3D illustrates a configuration obtained in response to rotating first permanent magnet 104 about first rotational axis 106 by 135° counterclockwise. Similarly, in response to first permanent magnet 104 further rotating about first rotational axis 106, second permanent magnet 108 and consequently third permanent magnet 128 may further rotate about their respective rotational axes (110, 130).

Figure 3E:
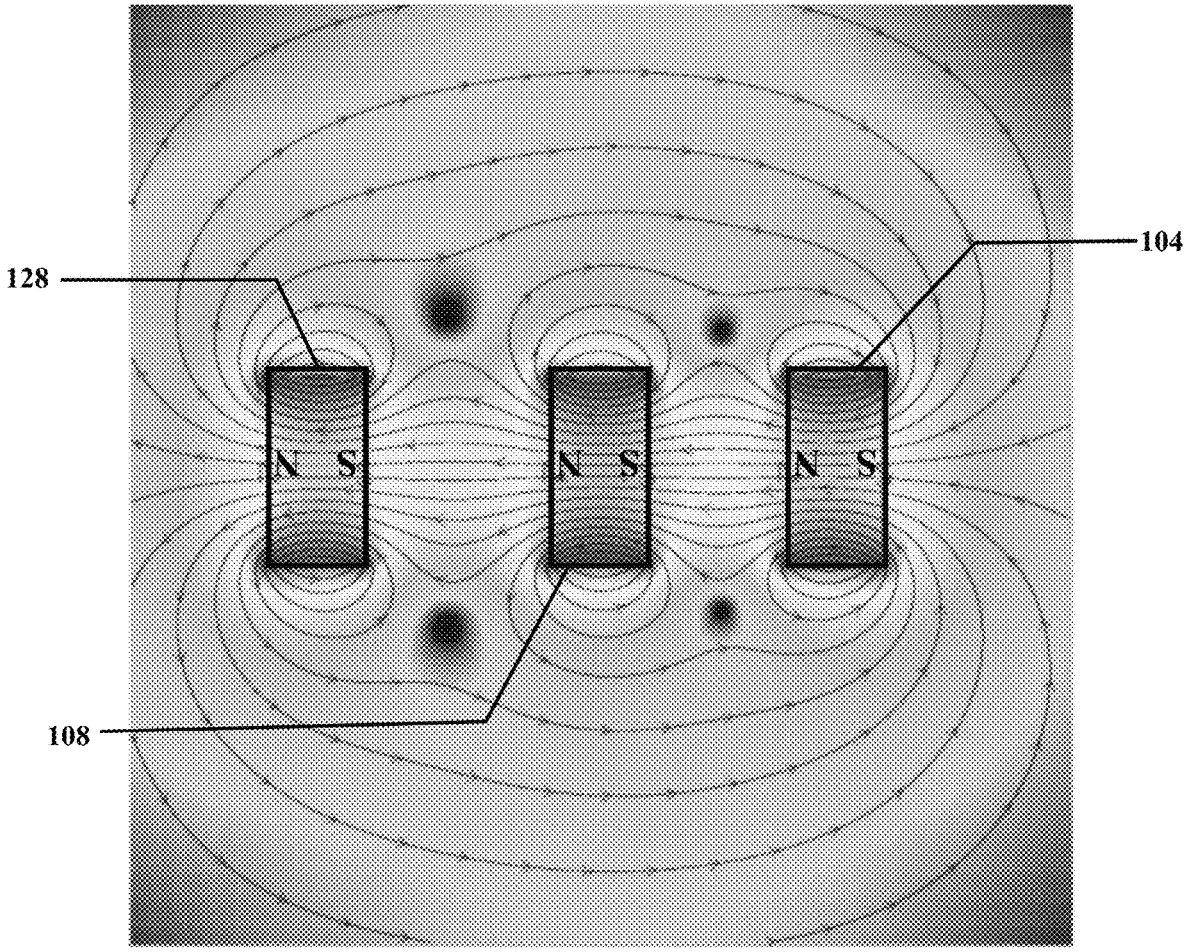

FIG. 3E illustrates magnetic field lines of first permanent magnet 104, second permanent magnet 108, and third permanent magnet 128 in a stable secondary configuration, where first permanent magnet 104, second permanent magnet 108, and third permanent magnet 128 have rotated 180° relative to their respective stable initial configuration as shown in FIG. 3A. In the stable secondary configuration, first permanent magnet 104, second permanent magnet 108, and third permanent magnet 128 may once again be aligned along main axis 112 with their respective opposite poles facing each other. Simply put, FIGS. 3A-3E illustrate how a rotational movement of first permanent magnet 104 about first rotational axis 106 may urge second permanent magnet 108 and third permanent magnet 128 to rotate about second rotational axis 110 and third rotational axis 130, respectively, under the influence of their respective magnetic fields.

In an exemplary embodiment, as mentioned before, first permanent magnet 104, second permanent magnet 108, and third permanent magnet 128 may be similarly shaped, sized, and magnetized magnets positioned at different distances from one another. For example, second permanent magnet 108 may be positioned at first distance 120 from first permanent magnet 104 along main axis 112 and third permanent magnet 128 may be positioned at second distance 132 from second permanent magnet 108 along main axis 112, where second distance 132 is longer than first distance 120. Such difference between the distances among exemplary permanent magnets of an exemplary permanent magnet actuating mechanism may allow for the magnetic force between first permanent magnet 104 and second permanent magnet 108 to be larger than the magnetic force between second permanent magnet 108 and third permanent magnet 128. In other words, second permanent magnet 108 may be subjected to a second magnetic force exerted by third permanent magnet 128 and a first magnetic force exerted by first permanent magnet 104. Since first permanent magnet 104 is functioning as a master permanent magnet that is to urge other magnets to rotate, in order for second permanent magnet 108 to follow first permanent magnet 104, the first magnetic force must be larger than the second magnetic force.

Calculating an attractive or repulsive magnetic force between two exemplary permanent magnets may be generally complex, since the magnetic force between two exemplary permanent magnets may depend on various factors, such as shape, magnetization, orientation, and the distance between exemplary permanent magnets. Consequently, an accurate calculation of the magnetic force between two exemplary permanent magnets or magnets in general may be challenging. Various models have been proposed to calculate the magnetic force between two magnets, one of the most widely used ones is the Gilbert model. In an exemplary embodiment, according to the Gilbert model, the force between two adjacent permanent magnets of an exemplary permanent magnet actuating mechanism may be calculated by utilizing Equation (1) below:

$$F \cong \left[\frac{B_0^2 A^2 (L^2 + R^2)}{\pi \mu_0 L^2}\right]\left[\frac{1}{x^2} + \frac{1}{(x+2L)^2} - \frac{2}{(x+L)^2}\right] \quad \text{Equation (1)}$$

In the Equation (1) above, F denotes the magnetic force between two adjacent exemplary magnets, μ denotes the permeability of the intervening medium between the two adjacent magnets, Bo denotes the flux density at each pole of each magnet, A denotes the area of each pole, L denotes the length of each magnet, R denotes the radius of each magnet, and x denotes the distance between the two magnets. According to Equation (1) above, for two similar permanent magnets that may be positioned at a predetermined distance from each other, the longer the predetermined distance the smaller the magnetic force between the two permanent magnets.

In an exemplary embodiment, exemplary permanent magnets of an exemplary permanent magnet actuating mechanism may be similarly shaped, sized, and magnetized permanent magnets linearly positioned along a main axis, such that the distance between each pair of permanent magnets of exemplary permanent agents may increase by a predetermined increment moving away from the first permanent magnet of exemplary permanent magnets along the main axis. In an exemplary embodiment, a distance between each pair of permanent magnets may consecutively increase by an increment in a range of 5 to 10 percent along main axis 112 moving away from first permanent magnet 104. For example, second distance 132 may be longer than first distance 120 by 5 to 10 percent of first distance 120 and third distance 140 may be longer than second distance 132 by a predetermined increment in a range of 5 to 10 percent of second distance 132. In other words, a distance between each pair of adjacent permanent magnets may be longer than a distance between the previous pair of adjacent permanent magnets by 5 to 10 percent.

In an exemplary embodiment, shading assembly 102 may include a plurality of blinds, such as blinds (103*a*, 103*b*, and 103*c*) that may be elongated solid structures. Such elongated solid structures may be mounted on an exemplary building to perform functions such as selectively allowing sunlight to pass through shading assembly 102 into an exemplary building. For example, plurality of exemplary blinds of shading assembly 102 may be rotated to a rotational position where a front face of an exemplary building may be at least partially covered by the plurality of exemplary blinds such that the sunlight may be at least partially blocked.

In an exemplary embodiment, permanent magnet actuating mechanism 100 may be coupled with shading assembly 102 to actuate the plurality of blinds of shading assembly 102. For example, permanent magnet actuating mechanism 100 may be coupled with blinds (103*a*, 103*b*, and 103*c*) to actuate rotational movements of blinds (103*a*, 103*b*, and 103*c*) about respective longitudinal axes of blinds (103*a*, 103*b*, and 103*c*). As used herein, a longitudinal axis of an object may refer to an axis that may be associated with the longest dimension of that object. For example, a longitudinal axis 105*a* of blind 103*a*, a longitudinal axis 105*b* of blind 103*b*, and a longitudinal axis 105*c* of blind 103*c* are illustrated in FIG. 1.

In an exemplary embodiment, coupling of permanent magnet actuating mechanism 100 with blinds (103*a*, 103*b*, and 103*c*) may allow for closing or opening shading assembly 102. To this end, each permanent magnet or at least some permanent magnets of permanent magnet actuating mechanism 100 may be directly or indirectly coupled with each blind of the plurality of blinds of shading assembly 102. For example, first permanent magnet 104 may be directly or indirectly coupled with a first blind 103*a* of shading assembly 102, second permanent magnet 108 may be directly or indirectly coupled with a second blind 103*b* of shading assembly 102, and fourth permanent magnet 136 may be directly or indirectly coupled with a third blind 103*c* of shading assembly 102.

In an exemplary embodiment, each permanent magnet of an exemplary permanent magnet actuating mechanism may be coupled with a respective blind of an exemplary shading assembly via a gearbox and a linear actuator. An exemplary gear box may be configured to change at least one of a speed or direction of the rotational movement of a respective permanent magnet of an exemplary permanent magnet actuating mechanism. An exemplary linear actuator, such as an exemplary belt-and-pulley mechanism may be configured to transfer rotational movements of exemplary permanent magnet rings to respective blinds of an exemplary shading assembly.

In an exemplary embodiment, the distances between consecutive permanent magnets of an exemplary permanent magnet actuating mechanism may be different in comparison with the distances between consecutive blinds of an exemplary shading mechanism. In an exemplary embodiment, such offset between rotational axes of permanent magnets and longitudinal axes of respective blinds may be compensated for by utilizing belt-and-pulley mechanisms of different lengths. In an exemplary embodiment, such offset between rotational axes of permanent magnets and longitudinal axes of respective blinds may further be compensated for by only coupling a permanent magnet closest to a respective blind to that blind and utilizing other adjacent permanent magnets as connecting rings of a chain of permanent magnets of an exemplary permeant magnet actuating mechanism. For example, as illustrated in (FIG. 1??), first permanent magnet 104 may be coupled with first blind 103*a* via a first gear box 107*a* and a first belt-and-pulley mechanism 109*a*, second permanent magnet 108 may be coupled with second blind 103*b* via a second gear box 107*b* and a second belt-and-pulley mechanism 109*b*, and fourth permanent magnet 138 may be coupled with third blind 103*c* via a third gear box 107*c* and a third belt-and-pulley mechanism 109*c*. In an exemplary embodiment, third permanent magnet 128 is not coupled to a respective blind of shading assembly 102, however third permanent magnet 128 may fill the gap between second permanent magnet 108 and fourth permanent magnet 136 and may be configured to transfer the rotational movement of second permanent magnet 108 to fourth permanent magnet 136.

As mentioned above in the preceding paragraphs, an exemplary permanent magnet actuating mechanism may have multiple permanent magnets rotatably mounted next to each other. For example, permanent magnet actuating mechanism 100 may include first permanent magnet 104, second permanent magnet 108, third permanent magnet 128, and fourth permanent magnet 136, the distance among which increases moving away from first permanent magnet 104. For example, first distance 120 between first permanent magnet 104 and second permanent magnet 108 may be smaller than second distance 132 between second permanent magnet 108 and third permanent magnet 128. Similarly, second distance 132 between second permanent magnet 108 and third permanent 128 magnet may be smaller than third distance 140 between third permanent magnet 128 and fourth permanent magnet 136.

Figure 2:
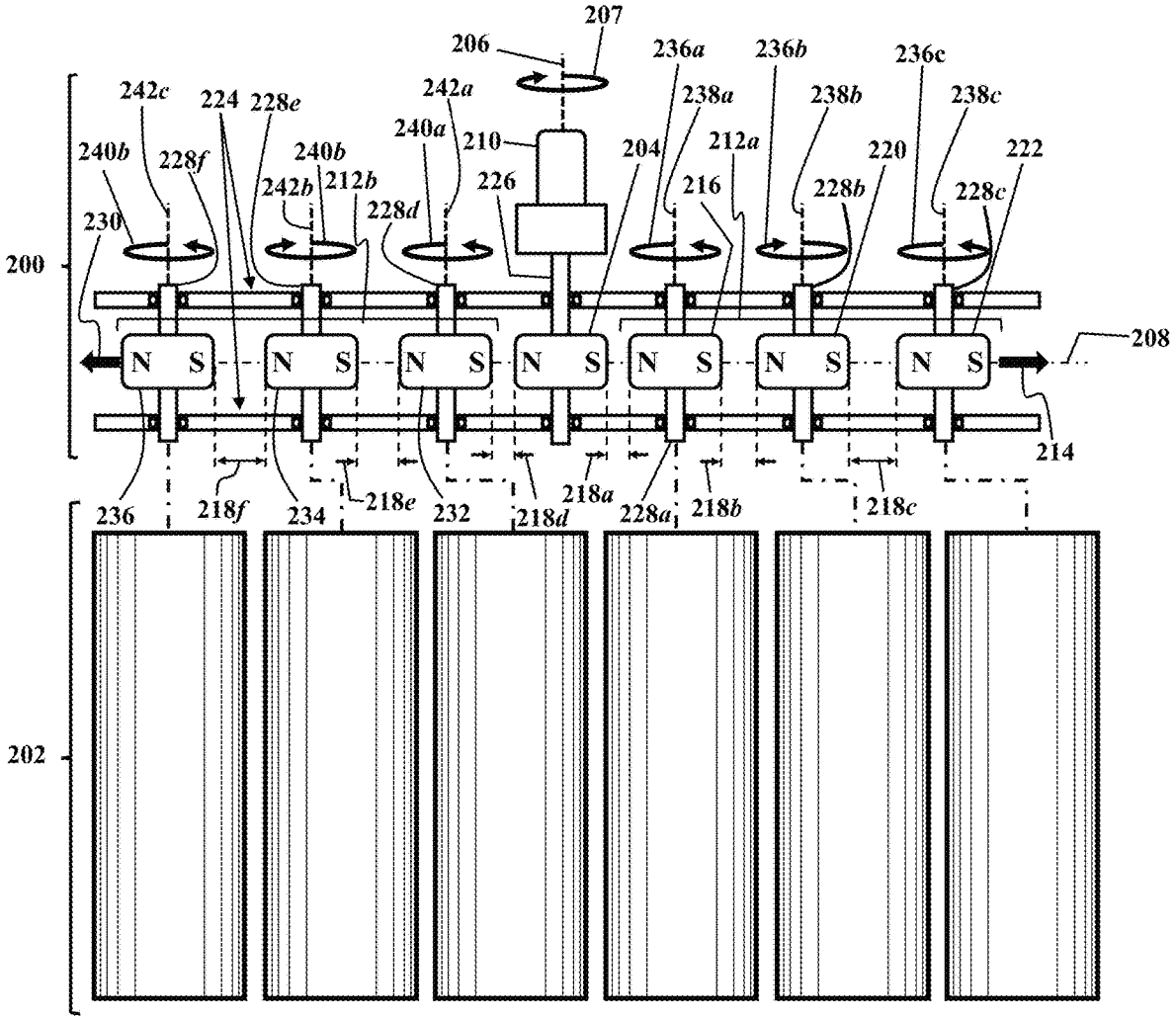
FIG. 2 illustrates a schematic side view of a permanent magnet actuating mechanism coupled to a plurality of blinds, consistent with one or more exemplary embodiments of the present disclosure.

FIG. 2 illustrates a schematic side view of a permanent magnet actuating mechanism 200 coupled to a plurality of blinds 202, consistent with one or more exemplary embodiments of the present disclosure. In an exemplary embodiment, permanent magnet actuating mechanism 200 may be structurally similar to permanent magnet actuating mechanism 100.

In an exemplary embodiment, permanent magnet actuating mechanism 200 may include a master permanent magnet 204 that may be rotatable about a main rotational axis 206. In an exemplary embodiment, master permanent magnet 204 may be magnetized along a main axis 208, where main axis 208 may be perpendicular to main rotational axis 206. In an exemplary embodiment, permanent magnet actuating mechanism 200 may further include a rotary motor 210 that may be coupled with master permanent magnet 204. In an exemplary embodiment, rotary motor 210 may be configured to drive a rotational movement of master permanent magnet 204 about main rotational axis 206.

In an exemplary embodiment, permanent magnet actuating mechanism 200 may further include a first plurality of slave magnets 212*a* mounted on a first side of master permanent magnet 204 along main axis 208. In an exemplary embodiment, each slave permanent magnet of first plurality of slave permanent magnets 212*a* may be magnetized along main axis 208 and may be rotatable about a respective rotational axis parallel with main rotational axis 206. In an exemplary embodiment, a distance between each pair of slave permanent magnets of first plurality of salve permanent magnets 212*a* may be consecutively increasing by a predetermined increment along main axis 208 moving away from master permanent magnet 204 in a direction shown by arrow 214. For example, first plurality of slave permanent magnets 212*a* may include a first slave permanent magnet 216 similar to first permanent magnet 104 that may be positioned at a first distance 218*a* from master permanent magnet 204, a second slave permanent magnet 220 similar to second permanent magnet 108 that may be positioned at a second distance 218*b* from first slave permanent magnet 216, and a third slave permanent magnet 222 similar to third permanent magnet 128 that may be positioned at a third distance 218*c* from second slave permanent magnet 220. In an exemplary embodiment, third distance 218*c* may be longer than second distance 218*b* and second distance 218*b* may be longer than first distance 218*a*.

In an exemplary embodiment, master permanent magnet 204 and an adjacent slave permanent magnet of first plurality of permanent magnets 212*a* may face each other with opposite poles and each pair of slave magnets of first plurality of slave magnets 212*a* face each other with opposite poles. In other words, master permanent magnet 204 and first slave permanent magnet 216 may face each other with opposite poles. For example, South (S) pole of master permanent magnet 204 may face North (N) pole of first slave permanent magnet 216. Similarly, first slave permanent magnet 216 and second slave permanent magnet 220 may face each other with opposite poles. Second slave permanent magnet 220 and third slave permanent magnet 222 may face each other with opposite poles.

In an exemplary embodiment, permanent magnet actuating mechanism 200 may further include a mounting structure 224 that may be configured to house and support master permanent magnet 204 and first plurality of slave permanent magnets 212*a*. In an exemplary embodiment, mounting structure 224 may include a main shaft 226 that may extend along main rotational axis 206. In an exemplary embodiment, main shaft 226 may be coupled with master permanent magnet 204 and may be rotatable with master permanent magnet 204 about main rotational axis 206.

In an exemplary embodiment, mounting structure 224 may further include a first plurality of shafts (228*a*-228*c*), where each shaft of first plurality of shafts (228*a*-228*c*) may extend parallel with main shaft 226. In an exemplary embodiment, each shaft of first plurality of shafts (228*a*-228*c*) may be coupled with a corresponding slave permanent magnet of first plurality of slave permanent magnets 212*a*. In an exemplary embodiment, each shaft of first plurality of shafts (228*a*-228*c*) may be rotatable with a respective slave permanent magnet of first plurality of slave permanent magnets 212*a* about a respective rotational axis parallel with main rotational axis 206. For example, first shaft 228*a* may be coupled with first slave permanent magnet 216 and may be rotatable with first slave permanent magnet 216 in a first direction 236*a* about a first rotational axis 238*a*. In an exemplary embodiment, second shaft 228*b* may be coupled with second slave permanent magnet 220 and may be rotatable with second slave permanent magnet 220 in a second direction 236*b* about a second rotational axis 238*b*. In an exemplary embodiment, third shaft 228*c* may be coupled with third slave permanent magnet 222 and may be rotatable with third slave permanent magnet 222 in a third direction 236*c* about a third rotational axis 238*c*. In an exemplary embodiment, in response to main shaft 226 being rotated in a clockwise direction as shown by arrow 207, first direction 236*a* may be counterclockwise, second direction 236*b* may be clockwise, and third direction 236*c* may be counterclockwise.

In an exemplary embodiment, permanent magnet actuating mechanism 200 may further include a second plurality of slave magnets 212*b* mounted on a second side of master permanent magnet 204 along main axis 208. In an exemplary embodiment, each slave permanent magnet of second plurality of slave permanent magnets 212*b* may be magnetized along main axis 208 and may be rotatable about a respective rotational axis parallel with main rotational axis 206. In an exemplary embodiment, a distance between each pair of slave permanent magnets of second plurality of salve permanent magnets 212*b* may be consecutively increasing by a predetermined increment along main axis 208 moving away from master permanent magnet 204 in a direction shown by arrow 230. For example, second plurality of slave permanent magnets 212*b* may include a fourth slave permanent magnet 232 that may be positioned at a fourth distance 218*d* from master permanent magnet 204, a fifth slave permanent magnet 234 that may be positioned at a fifth distance 218*e* from fourth slave permanent magnet 232, and a sixth slave permanent magnet 236 that may be positioned at a sixth distance 218*f* from fifth slave permanent magnet 234. In an exemplary embodiment, fourth distance 218*d* may be equal to first distance 218*a*, fifth distance 218*e* may be equal to second distance 218*b*, and sixth distance 218*f* may be equal to third distance 218*c*. Furthermore, fourth distance 218*d* may be shorter than fifth distance 218*e* and fifth distance 218*e* may be shorter than sixth distance 218*f*.

In an exemplary embodiment, each slave permanent magnet of second plurality of salve permanent magnets 212*b* may be polarized similar to master permanent magnet 204 and adjacent pairs of slave permanent magnets of second plurality of permanent magnets 212*b* may face each other with opposite poles.

In an exemplary embodiment, mounting structure 224 may further be configured to house and support second plurality of slave permanent magnets 212*b*. In an exemplary embodiment, mounting structure 224 may further include a second plurality of shafts (228*d*-228*f*), where each shaft of second plurality of shafts (228*d*-228*f*) may extend parallel with main shaft 226. In an exemplary embodiment, each shaft of second plurality of shafts (228*d*-228*f*) may be coupled with a corresponding slave permanent magnet of second plurality of slave permanent magnets 212*b*. In an exemplary embodiment, each shaft of second plurality of shafts (228*d*-228*f*) may be rotatable with a respective slave permanent magnet of second plurality of slave permanent magnets 212*b* about a respective rotational axis parallel with main rotational axis 206. For example, fourth shaft 228*d* may be coupled with fourth slave permanent magnet 232 and may be rotatable with fourth slave permanent magnet 232 in a fourth direction 240*a* about a fourth rotational axis 242*a*. In an exemplary embodiment, fifth shaft 228*e* may be coupled with fifth slave permanent magnet 234 and may be rotatable with fifth slave permanent magnet 234 in a fifth direction 240*b* about a fifth rotational axis 242*b*. In an exemplary embodiment, sixth shaft 228*f* may be coupled with sixth slave permanent magnet 236 and may be rotatable with sixth slave permanent magnet 236 in a sixth direction 240*c* about a sixth rotational axis 242*c*. In an exemplary embodiment, in response to main shaft 226 being rotated in a clockwise direction as shown by arrow 207, fourth direction 240*a* may be counterclockwise, fifth direction 240*b* may be clockwise, and sixth direction 240*c* may be counterclockwise.

In an exemplary embodiment, rotary motor of rotary motor 210 may rotate master permanent magnet 204, which in turn urges first plurality of slave permanent magnets 212*a* and second plurality of slave permanent magnets 212*b* to rotate. Such rotational movement of first plurality of slave permanent magnets 212*a* and second plurality of slave permanent magnets 212*b* may at least partially be utilized for urging an end effector or an external user to move. For example, first plurality of slave permanent magnets 212*a* and second plurality of slave permanent magnets 212*b* may be at least partially coupled with plurality of blinds 202 and may be configured to transfer the rotational movement of rotary motor 210 to plurality of blinds 202. As used herein, partially coupled may refer to the fact that some permanent magnets of first plurality of slave permanent magnets 212*a* and second plurality of slave permanent magnets 212*b* may not be coupled to a respective blind of plurality of blinds 202 and may instead function as motion transferring elements among other permanent magnets of first plurality of slave permanent magnets 212*a* and second plurality of slave permanent magnets 212*b*. For example, master permanent magnet 204 may not be coupled to any of plurality of blinds 202 and may function as a motion transferring element that may be configured to transfer the rotational movement of rotary motor 210 to first slave permanent magnet 216 and fourth slave permanent magnet 232. In another example, any slave permanent magnet of exemplary slave permanent magnets may as well be utilized for transferring motion between their respective adjacent permanent magnets and not for transferring motion to an external element. For example, third permanent magnet 128, which functions as a slave permanent magnet in permanent magnet actuating mechanism 100 is not coupled to any of blinds (103*a*, 103*b*, or 103*c*), but may instead be configured to transfer the rotational motion of second permanent magnet 108 to fourth permanent magnet 136.

The embodiments have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for description and not of limitation, such that the terminology or phraseology of the present specification is to be interpreted by the skilled artisan in light of the teachings and guidance.

The breadth and scope of the present disclosure should not be limited by any of the above-described exemplary embodiments but should be defined only in accordance with the following claims and their equivalents.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps. Moreover, the word "substantially" when used with an adjective or adverb is intended to enhance the scope of the particular characteristic, e.g., substantially planar is intended to mean planar, nearly planar and/or exhibiting characteristics associated with a planar element. Further use of relative terms such as "vertical", "horizontal", "up", "down", and "side-to-side" are used in a relative sense to the normal orientation of the apparatus.

What is claimed is:

1. A permanent magnet actuation mechanism, comprising:

a first permanent magnet magnetized along a first axis, the first permanent magnet rotatable about a first rotational axis perpendicular to the first axis, the first permanent magnet rotatable between a first primary position and a first secondary position, the first secondary position corresponding to a position of the first permanent magnet rotated by 180° about the first rotational axis, with respect to the first primary position;

a second permanent magnet magnetized along a second axis, the second permanent magnet rotatable about a second rotational axis perpendicular to the second axis, the second permanent magnet rotatable between a second primary position and a second secondary position, the second rotational axis parallel with the first rotational axis, the second secondary position corresponding to a position of the second permanent magnet rotated by 180° about the second rotational axis, with respect to the second primary position;

a mounting structure configured to position the first permanent magnet at a first distance from the second permanent magnet along a main axis perpendicular to the first rotational axis and the second rotational axis, wherein the first permanent magnet and the second permanent magnet are magnetized along the main axis, the first permanent magnet and the second permanent magnet configured to face each other with opposite poles in the corresponding first initial position and the second initial position, wherein rotation of the first permanent magnet about the first rotational axis from the first primary position to the first secondary position in a first direction actuates a rotation of the second permanent magnet about the second rotational axis from the second primary position to the second secondary position in a second direction, the second direction opposite the first direction.

2. The permanent actuating mechanism of claim 1, wherein the mounting structure comprises:

a first shaft extended along the first rotational axis and coupled with the first permanent magnet, the first shaft rotatable with the first permanent magnet about the first rotational axis; and a second shaft extended along the second rotational axis and coupled with the second permanent magnet, the second shaft rotatable with the second permanent magnet about the second rotational axis.

3. The permanent actuating mechanism of claim 1, wherein the first shaft is coupled to a rotary motor, the rotary motor configured to drive a rotational movement of the first shaft about the first rotational axis.

4. The permanent actuating mechanism of claim 1, further comprising:

a third permanent magnet rotatable about a third rotational axis between a third primary position and a third secondary position, the third rotational axis parallel with the second rotational axis, the third permanent magnet mounted on the mounting structure, wherein the mounting structure is configured to position the third permanent magnet at a second distance from the second permanent magnet along the main axis, the second distance longer than the first distance, wherein the third permanent magnet is magnetized along the main axis, the third permanent magnet and the second permanent magnet configured to face each other with opposite poles in the corresponding third initial position and the second initial position, and wherein rotation of the third permanent magnet about the third rotational axis from the third primary position to the third secondary position in a third direction actuates a rotation of the second permanent magnet about the second rotational axis from the second primary position to the second secondary position in the second direction, the third direction opposite the second direction.

5. The permanent actuating mechanism of claim 4, wherein the mounting structure comprises:

a first shaft extended along the first rotational axis and coupled with the first permanent magnet, the first shaft rotatable with the first permanent magnet about the first rotational axis;

a second shaft extended along the second rotational axis and with the second permanent magnet, the second shaft rotatable with the second permanent magnet about the second rotational axis; and a third shaft extended along the third rotational axis and with the third permanent magnet, the third shaft rotatable with the third permanent magnet about the third rotational axis.

6. The permanent actuating mechanism of claim 5, wherein the first shaft is coupled to a rotary motor, the rotary motor configured to drive a rotational movement of the first shaft about the first rotational axis.

7. The permanent actuating mechanism of claim 4, wherein each of the first permanent magnet, the second permanent magnet, and the third permanent magnet comprises a permanent slab magnet axially magnetized along the main axis.

8. A permanent magnet actuation mechanism, comprising:

a master permanent magnet rotatable about a first rotational axis, the master permanent magnet magnetized along a main axis, the main axis perpendicular to the first rotational axis;

a rotary motor coupled with the master permanent magnet, the rotary motor configured to drive a rotational movement of the master permanent magnet about the first rotational axis; and a first plurality of slave magnets mounted on a first side of the master permanent magnet along the main axis, each slave permanent magnet of the first plurality of slave permanent magnets magnetized along the main axis, each slave permanent magnet of the first plurality of slave permanent magnets rotatable about a respective rotational axis parallel with the first rotational axis, a distance between each pair of slave permanent magnets of the first plurality of salve permanent magnets consecutively increasing by a predetermined increment along the main axis moving away from the master permanent magnet.

9. The permanent magnet actuation mechanism of claim 8, wherein the predetermined increment is in a range of 5 to 10 percent.

10. The permanent magnet actuation mechanism of claim 9, wherein the master permanent magnet and an adjacent slave permanent magnet of the first plurality of permanent magnets face each other with opposite poles, and each pair of slave magnets of the first plurality of slave magnets face each other with opposite poles.

11. The permanent magnet actuation mechanism of claim 10, further comprising a mounting structure, the mounting structure comprising:

a main shaft extended along the first rotational axis, the main shaft coupled with the master permanent magnet, the main shaft rotatable with the master permanent magnet about the first rotational axis; and a first plurality of shafts, each shaft of the first plurality of shafts extended parallel with the main shaft, each shaft of the first plurality of shafts coupled with a corresponding slave permanent magnet of the first plurality of slave permanent magnets, each shaft of the first plurality of shafts rotatable with a respective slave permanent magnet of the first plurality of slave permanent magnets about a respective rotational axis parallel with the first rotational axis.

12. The permanent magnet actuation mechanism of claim 11, further comprising:

a second plurality of slave magnets mounted on a second opposite side of the master permanent magnet along the main axis, each slave permanent magnet of the second plurality of slave permanent magnets magnetized along the main axis, each slave permanent magnet of the second plurality of slave permanent magnets rotatable about a respective rotational axis parallel with the first rotational axis, a distance between each pair of slave permanent magnets of the second plurality of salve permanent magnets consecutively increasing by the predetermined increment along the main axis moving away from the master permanent magnet.

13. The permanent magnet actuation mechanism of claim 12, wherein the master permanent magnet and an adjacent slave permanent magnet of the second plurality of permanent magnets face each other with opposite poles, and each pair of slave magnets of the second plurality of slave magnets face each other with opposite poles.

14. The permanent magnet actuation mechanism of claim 13, wherein the mounting structure further comprises:

a second plurality of shafts, each shaft of the second plurality of shafts extended parallel with the main shaft, each shaft of the second plurality of shafts coupled with a corresponding slave permanent magnet of the first plurality of slave permanent magnets, each shaft of the second plurality of shafts rotatable with a respective slave permanent magnet of the slave permanent magnets about a respective rotational axis parallel with the first rotational axis.

* * * * *